US005584248A

United States Patent [19]

Sandsted et al.

[11] Patent Number: 5,584,248

[45] Date of Patent: Dec. 17, 1996

[54] SPLIT TOOL MECHANICAL VIBRATOR

[75] Inventors: Craig A. Sandsted, Irmo; Roy J. Moore, Cola; Anthony P. Delucia, Gaston; Marion D. Smith, Batesburg, all of S.C.

[73] Assignee: Harsco Corporation, Wormleysburg, Pa.

[21] Appl. No.: 408,279

[22] Filed: Mar. 22, 1995

[51] Int. Cl.[6] ..... E01B 27/16

[52] U.S. Cl. ..... 104/12

[58] Field of Search ..... 104/10, 12, 14

[56] References Cited

U.S. PATENT DOCUMENTS

| | | | |
|---|---|---|---|
| 3,669,025 | 6/1972 | Plasser et al. | 104/12 |
| 3,677,187 | 7/1972 | Stewart | 104/10 |
| 3,951,096 | 4/1976 | Dunlap | 440/57 |
| 3,998,165 | 12/1976 | Jaeggi | 104/12 |
| 4,332,200 | 6/1982 | Ganz | 104/12 |
| 4,501,200 | 2/1985 | Delucia | 104/10 |
| 4,576,095 | 3/1986 | Theurer | 104/12 |
| 4,744,303 | 5/1988 | Pasquini | 104/12 |
| 5,146,677 | 9/1992 | Holman et al. . | |
| 5,269,225 | 12/1993 | Bosshart et al. . | |

OTHER PUBLICATIONS

Dura–Belt Advertisement, undated.

*Primary Examiner*—Robert J. Oberleitner
*Assistant Examiner*—Kevin D. Rutherford
*Attorney, Agent, or Firm*—William L. Feeney; Kerkam, Stowell, Kondracki & Clarke,P.C.

[57] ABSTRACT

A tamping vehicle uses a split tool mechanical vibrator having corresponding front and back vibrator units powered by a single motor. Sprockets and a synchronous sprocket belt drive front and back units to vibrate 180 degrees out of phase. A lubricant carrying belt carries oil to the top of a housing for lubricating and cooling various moving parts. Squeeze cylinders are used to move tamping tools to squeeze in positions by rotating the tamping tools about the same axes as rotation of vibration inducing shafts. Independently liftable gauge and field side tamping assemblies allow use at railroad switches and other locations where narrow width tamping is needed. A tamping tool provides easy connection to a tamping tool holder in such a way that two tamping tools may be mounted to one tool holder.

25 Claims, 6 Drawing Sheets

SPLIT TOOL MECHANICAL VIBRATOR

BACKGROUND OF THE INVENTION

The present invention relates to an apparatus for maintenance of railroad beds. Specifically, it relates to a tamping apparatus and related tamping tool.

In the maintenance of road beds of railroads, the ballast must be periodically stabilized. Specifically, the rocks which make up the ballast are vibrated to get them into a compact stable state. Additionally, ballast should be pushed under the cross ties of the road bed in order to insure a stable support for the cross ties.

Various tamping machines have been used. Generally, such machines are rail vehicles which travel to a part of the road bed where tamping is required. Tamping tools are then lowered and vibrate into the ballast until in position where the tamping tools are moved to squeeze ballast under a cross tie. Specifically, tamping tools are disposed with paddles on their lower ends, the paddles being on opposite sides of a tie and below the level of the tie. The paddles are then pushed together to compress ballast under the tie, this being known as the squeeze in or squeeze position.

Prior U.S. Pat. No. 4,501,200 of Anthony Delucia, one of the inventors herein, describes a TAMPING TOOL RETAINER having an advantageous manner of connecting a tamping tool to a tool holder.

Standard tamping vibrator units have a width which makes it difficult or impossible to use them in tamping ballast at some locations around rail switches.

For switches, one could use two separate vibrators for opposite sides of a tie, but this might require two separate hydraulic or other motors to drive the corresponding front and back tamping tool holders associated with the respective front and back vibrator units. A two motor arrangement introduces additional costs and requires extra space for the second motor. Further, a two motor arrangement makes it difficult or impossible to coordinate the vibration of one unit with the vibration of the other unit.

Vibrator units often have required relatively complex arrangements in order to provide both the vibration supplied to the tamping tool in order to ease its insertion to the appropriate depth in the ballast and to provide the squeeze in movement.

Many vibrator units have tamping tool holders wherein removal and insertion of a tamping tool may require access to bolts, nuts, or other fasteners which are in difficult to access locations. In other words, removal or insertion of an old or replacement tamping tool into the holder may be difficult. In corresponding fashion, many tamping tool designs require bolting in a difficult to access location where clearance for use of a wrench or other tool is quite limited and/or visual observation is difficult.

OBJECTS AND SUMMARY OF THE INVENTION

Accordingly, it is a primary object of the present invention to provide a new and improved tamping vibrator assembly.

A more specific object of the present invention is to provide a tamping assembly with a relatively narrow width tamping vibrator assembly.

A further object of the present invention is to provide two vibrators operated by a single motor with their vibrations coordinated.

Yet another object of the present invention is to provide a unique arrangement for vibrating and squeezing actions which is relatively simple.

A further object of the present invention is to provide a lubrication technique for a vibrator.

Yet another object of the present invention is to provide an improved tamping tool and corresponding tamping tool holder.

A still further object of the present invention is to provide a tamping assembly which avoids or minimizes the disadvantages noted above.

The above and other features of the present invention, which will be more readily understood when the following detailed description is considered in conjunction with the accompanying drawings, are realized by a railroad ballast tamping apparatus which includes a first tamping assembly having a first front vibration inducing shaft rotatable about a first front axis. A first front tamping tool holder has a lower end accommodating a tamping tool thereon, the first front tamping tool holder being operably connected to the first front vibration inducing shaft such that rotation of the first front vibration inducing shaft about the first front axis causes vibration of any tamping tool connected to the first front tamping tool holder. A first front belt wheel portion is connected to rotate with the first front vibration inducing shaft. A first back vibration inducing shaft is rotatable about a first back axis. A first back tamping tool holder has a lower end accommodating a tamping tool thereon, the first back tamping tool holder being operably connected to the first back vibration inducing shaft such that rotation of the first back vibration inducing shaft about the first back axis causes vibration of any tamping tool connected to the first back tamping tool holder. A first back belt wheel portion is connected to rotate with the first back vibration inducing shaft. A first drive motor is operably connected to a driving one of the first front vibration inducing shaft and first back vibration inducing shaft. A first belt connects the first front belt wheel portion and the first back belt wheel portion such that rotation of the driving one of the first front vibration inducing shaft and first back vibration inducing shaft will in turn rotate the other one of the first front vibration inducing shaft and first back vibration inducing shaft.

The first tamping assembly further includes a first front eccentric portion on the first front vibration inducing shaft and a first front connector pivotably connected to an upper end of the first front tamping tool holder and connected to the first front eccentric portion such that rotation of the first eccentric portion moves the first front connector back and forth which in turn vibrates the first front tamping tool holder and any tamping tool mounted thereto. A first back eccentric portion is on the first back vibration inducing shaft and a first back connector pivotably connects to an upper end of the first back tamping tool holder and connects to the first back eccentric portion such that rotation of the first eccentric portion moves the first back connector back and forth which in turn vibrates the first back tamping tool holder and any tamping tool mounted thereto.

The first tamping assembly further includes at least one tamping tool mounted to the first front tamping tool holder and at least one tamping tool mounted to the first back tamping tool holder.

The first tamping assembly may further include two tamping tools mounted to one of the first front tamping tool holder and the first back tamping tool holder, each tamping tool having a tamping paddle at a bottom thereof and having a tool holder interface at a top thereof. The tool holder interface has a generally vertical surface which faces an opposing outer surface of the one of the first front tamping tool holder and the first back tamping tool holder with the two tamping tools secured to opposite sides thereof.

The first tamping assembly may include at least one tamping tool mounted to one of the first front tamping tool holder and the first back tamping tool holder. The tamping tool has a tamping paddle at a bottom thereof and having a tool holder interface at a top thereof, the tool holder interface having a generally vertical surface which faces an opposing outer surface of a tamping tool holder with the tamping tool secured to a tamping tool holder.

The first tamping assembly further includes two tamping tools mounted externally to one of the first front tamping tool holder and the first back tamping tool holder, each tamping tool having a tamping paddle at a bottom thereof and having a tool holder interface at a top thereof. Each tool holder interface has a generally vertical surface which faces an opposing outer surface of a tamping tool holder with the tamping tool secured to a tamping tool holder. Each tool holder interface is a channel having its generally vertical surface as the floor of the channel and having two opposite channel sidewalls, the channel sidewalls and floor partially wrapping about the tamping tool holder to which the two tamping tools are mounted.

The first tamping assembly further includes a first carrier supporting (i.e., directly or indirectly) the first front vibration inducing shaft and the first front tamping tool holder. A first front squeeze actuator is connected to the first carrier and operably connected to the first front tamping tool holder to move any tamping tool mounted to the first front tamping tool holder between a normal position and a squeeze in position by rotating the first front tamping tool holder about the first front axis. The first carrier supports the first back vibration inducing shaft and the first back tamping tool holder. A first back squeeze actuator is connected to the first carrier and operably connected to the first back tamping tool holder to move any tamping tool mounted to the first back tamping tool holder between a normal position and a squeeze in position by rotating the first back tamping tool holder about the first back axis.

The first tamping assembly further includes a housing about at least a portion of first front vibration inducing shaft and an upper portion of the first front tamping tool holder, the housing having a lubricant sump at a lower portion thereof. A lubricant carrying belt is within the housing and is driven by the first vibration inducing shaft to carry lubricant from the lubricant sump up for lubrication above the lubricant sump.

The first front belt wheel portion and the first back belt wheel portion are respectively first front and first back sprockets.

The railroad ballast tamping apparatus may further include a second tamping assembly having a second front vibration inducing shaft rotatable about a second front axis. A second front tamping tool holder has a lower end accommodating a tamping tool thereon, the second front tamping tool holder being operably connected to the second front vibration inducing shaft such that rotation of the second front vibration inducing shaft about the second front axis causes vibration of any tamping tool connected to the second front tamping tool holder. A second front belt wheel portion is connected to rotate with the second front vibration inducing shaft. A second back vibration inducing shaft is rotatable about a second back axis. A second back tamping tool holder has a lower end accommodating a tamping tool thereon, the second back tamping tool holder being operably connected to the second back vibration inducing shaft such that rotation of the second back vibration inducing shaft about the second back axis causes vibration of any tamping tool connected to the second back tamping tool holder. A second back belt wheel portion which is connected to rotate with the second back vibration inducing shaft. A second drive motor is operably connected to a driving one of the second front vibration inducing shaft and second back vibration inducing shaft. A second belt connects the second front belt wheel portion and the second back belt wheel portion such that rotation of the driving one of the second front vibration inducing shaft and second back vibration inducing shaft will in turn rotate the other one of the second front vibration inducing shaft and second back vibration inducing shaft. The first and second tamping assemblies are supported for independent vertical movement by a tamping vehicle, one of the first and second tamping assemblies being a field side assembly and the other of the first and second assemblies being a gauge side assembly.

The present invention may alternately be described as a railroad ballast tamping apparatus including a first vibration inducing shaft rotatable about a first axis. A first drive motor is operably connected to the first vibration inducing shaft. A first tamping tool holder has a lower end accommodating a tamping tool thereon. The first tamping tool holder is operably connected to the first vibration inducing shaft such that rotation of the first vibration inducing shaft about the first axis causes vibration of any tamping tool connected to the first tamping tool holder. A first carrier supports the first vibration inducing shaft and the first tamping tool holder. A first squeeze actuator is connected to the first carrier and operably connected to the first tamping tool holder to move any tamping tool mounted to the first tamping tool holder between a normal position and a squeeze in position by rotating the first tamping tool holder about the first axis.

The first tamping assembly further includes a first eccentric portion on the first vibration inducing shaft and a first connector pivotably connected to an upper end of the first tamping tool holder and connected to the first eccentric portion such that rotation of the first eccentric portion moves the first connector back and forth which in turn vibrates the first tamping tool holder and any tamping tool mounted thereto.

The first tamping assembly may further include two tamping tools mounted to the first tamping tool holder, each tamping tool having a tamping paddle at a bottom thereof and having a tool holder interface at a top thereof. The tool holder interface has two generally vertical surfaces which face corresponding and opposing outer surfaces of one of the two tamping tools, the two tamping tools being secured to opposite sides of the tool holder.

The first tamping assembly may further include at least one tamping tool mounted to the first tamping tool holder, the tamping tool having a tamping paddle at a bottom thereof and having a tool holder interface at a top thereof. The tool holder interface has a generally vertical surface which faces an opposing outer surface of the first tamping tool holder with the tamping tool secured thereto.

The first tamping assembly further includes a housing about at least a portion of first vibration inducing shaft and an upper portion of the first tamping tool holder, the housing having a lubricant sump at a lower portion thereof. A lubricant carrying belt is within the housing and driven by the first vibration inducing shaft to carry lubricant from the lubricant sump up for lubrication above the lubricant sump.

The first tamping assembly further includes a first belt wheel portion which is connected to rotate with the first vibration inducing shaft and a second vibration inducing shaft is rotatable about a second axis. A second tamping tool holder has a lower end accommodating a tamping tool thereon, the second tamping tool holder being operably connected to the second vibration inducing shaft such that rotation of the second vibration inducing shaft about the second axis causes vibration of any tamping tool connected to the second tamping tool holder. A second belt wheel portion is connected to rotate with the second vibration inducing shaft. A first belt connects the first belt wheel portion and the second belt wheel portion such that rotation of a driving one of the first vibration inducing shaft and second vibration inducing shaft will in turn rotate the other one of the first vibration inducing shaft and second vibration inducing shaft. The first drive motor rotates the driving one of the first vibration inducing shaft and second vibration inducing shaft and the first belt will in turn rotate the other one of the first vibration inducing shaft and second vibration inducing shaft.

The railroad ballast tamping apparatus further includes a second tamping assembly constructed in like fashion as recited for the first tamping assembly (in other words having second components corresponding to each of the recited first components). The first and second tamping assemblies are supported by a tamping vehicle for movement relative thereto.

The first tamping assembly further includes a first eccentric portion on the first vibration inducing shaft and a first connector pivotably connected to an upper end of the first tamping tool holder and connected to the first eccentric portion such that rotation of the first eccentric portion moves the first connector back and forth which in turn vibrates the first tamping tool holder and any tamping tool mounted thereto. A second eccentric portion is on the second vibration inducing shaft and a second connector is pivotably connected to an upper end of the second tamping tool holder and connected to the second eccentric portion such that rotation of the first eccentric portion moves the second connector back and forth which in turn vibrates the second tamping tool holder and any tamping tool mounted thereto. The first carrier supports the second vibration inducing shaft and the second tamping tool holder. A second squeeze actuator is connected to the first carrier and operably connected to the second tamping tool holder to move any tamping tool mounted to the second tamping tool holder between a normal position and a squeeze in position by rotating the second tamping tool holder about the second axis.

The present invention may alternately be described as a railroad ballast tamping apparatus including a first tamping assembly having a first vibration inducing shaft rotatable about a first axis. A first tamping tool holder has a lower end accommodating a tamping tool thereon, the first tamping tool holder being operably connected to the first vibration inducing shaft such that rotation of the first vibration inducing shaft about the first axis causes vibration of any tamping tool connected to the first tamping tool holder. A first housing is about at least a portion of first vibration inducing shaft and an upper portion of the first tamping tool holder, the first housing having a first lubricant sump at a lower portion thereof. A first lubricant carrying belt is within the first housing and driven by the first vibration inducing shaft to carry lubricant from the first lubricant sump up for lubrication above the first lubricant sump.

The first tamping assembly further includes a first idler wheel with the first lubricant carrying belt extending around the first idler wheel.

The first tamping assembly further includes a second vibration inducing shaft rotatable about a second axis. A second tamping tool holder has a lower end accommodating a tamping tool thereon, the second tamping tool holder being operably connected to the second vibration inducing shaft such that rotation of the second vibration inducing shaft about the second axis causes vibration of any tamping tool connected to the second tamping tool holder. A second housing is about at least a portion of second vibration inducing shaft and an upper portion of the second tamping tool holder, the second housing having a second lubricant sump at a lower portion thereof. A second lubricant carrying belt is within the second housing and driven by the second vibration inducing shaft to carry lubricant from the second lubricant sump up for lubrication above the second lubricant sump.

The first tamping assembly further includes a first belt wheel portion which is connected to rotate with the first vibration inducing shaft. A second vibration inducing shaft is rotatable about a second axis. A second tamping tool holder has a lower end accommodating a tamping tool thereon, the second tamping tool holder being operably connected to the second vibration inducing shaft such that rotation of the second vibration inducing shaft about the second axis causes vibration of any tamping tool connected to the second tamping tool holder. A second belt wheel portion is connected to rotate with the second vibration inducing shaft. A first belt connects the first belt wheel portion and the second belt wheel portion such that rotation of a driving one of the first vibration inducing shaft and second vibration inducing shaft will in turn rotate the other one of the first vibration inducing shaft and second vibration inducing shaft. The first drive motor rotates the driving one of the first vibration inducing shaft and second vibration inducing shaft and the first belt will in turn rotate the other one of the first vibration inducing shaft and second vibration inducing shaft.

The first tamping assembly further includes a first eccentric portion on the first vibration inducing shaft and a first connector pivotably connected to an upper end of the first tamping tool holder and connected to the first eccentric portion such that rotation of the first eccentric portion moves the first connector back and forth which in turn vibrates the first tamping tool holder and any tamping tool mounted thereto. At least one tamping tool is mounted to the first tamping tool holder, the tamping tool having a tamping paddle at a bottom thereof and having a tool holder interface at a top thereof. The tool holder interface having a generally vertical surface which faces an opposing outer surface of the first tamping tool holder.

The present invention may alternately be described as a railroad ballast tamping apparatus including a first tamping tool having a tamping paddle at a bottom thereof and having a tool holder interface at a top thereof, the tool holder interface having a generally vertical surface which faces an opposing outer surface of a tamping tool holder when the first tamping tool is secured to a tamping tool holder. The tool holder interface is a channel having its generally vertical surface as the floor of the channel and having two opposite channel sidewalls, the channel sidewalls and floor operable for partially wrapping about a tamping tool holder. The first tamping tool further includes at least one bolt hole extending from the floor through to an opposite surface of the first tamping tool. The two opposite channel sidewalls are tapered apart away from the floor. The first tamping tool is part of a tamping assembly, the tamping assembly further including a tamping tool holder having a lower end to which the first tamping tool is secured.

The tamping assembly further includes a first vibration inducing shaft rotatable about a first axis, the tamping tool holder being operably connected to the first vibration inducing shaft such that rotation of the first vibration inducing shaft about the first axis causes vibration of the first tamping tool. A first housing is about at least a portion of first vibration inducing shaft and an upper portion of the first tamping tool holder, the first housing having a first lubricant sump at a lower portion thereof. A first lubricant carrying belt is within the first housing and is driven by the first vibration inducing shaft to carry lubricant from the first lubricant sump up for lubrication above the first lubricant sump.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 1:
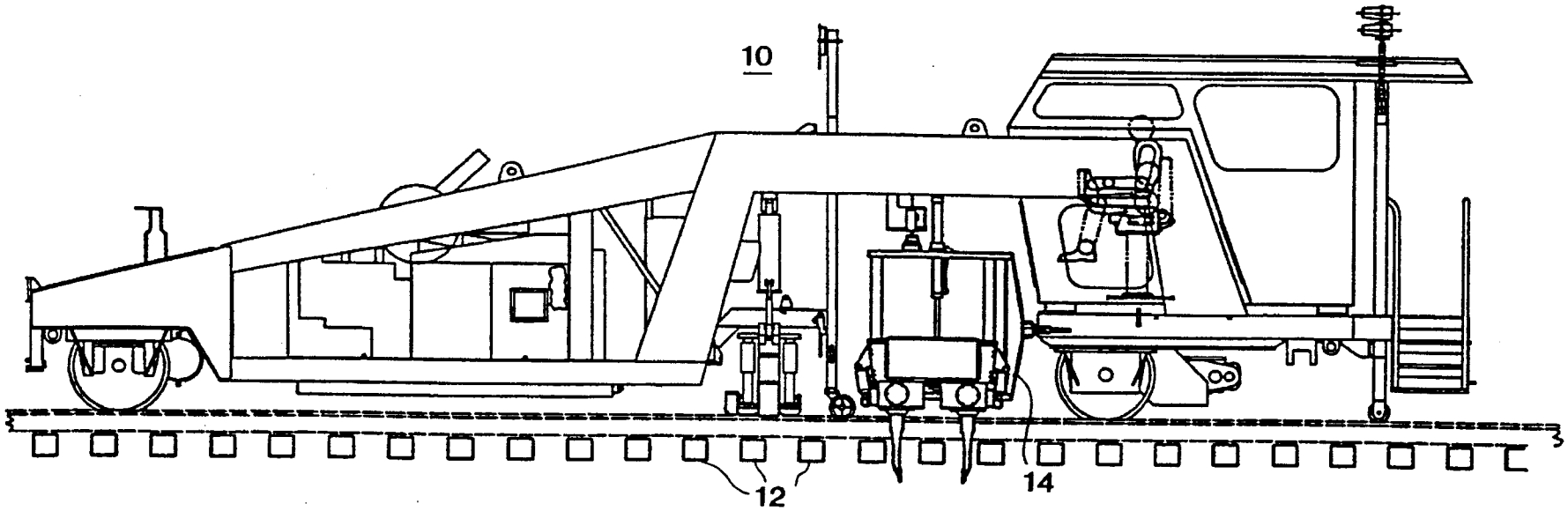
FIG. 1 is a side view of a rail bound tamping vehicle according to the present invention.

With reference now to FIG. 1, the tamping vehicle 10 of the present invention is a rail bound vehicle used for tamping of ballast (not shown) below the cross ties 12. A tamping assembly 14 is movably mounted to the vehicle 10. Since the vehicle is relatively standard with its 4 flanged wheels, power plant, and other components except for the tamping assembly 14, the discussion which follows will emphasize the tamping assembly 14.

Figure 2:
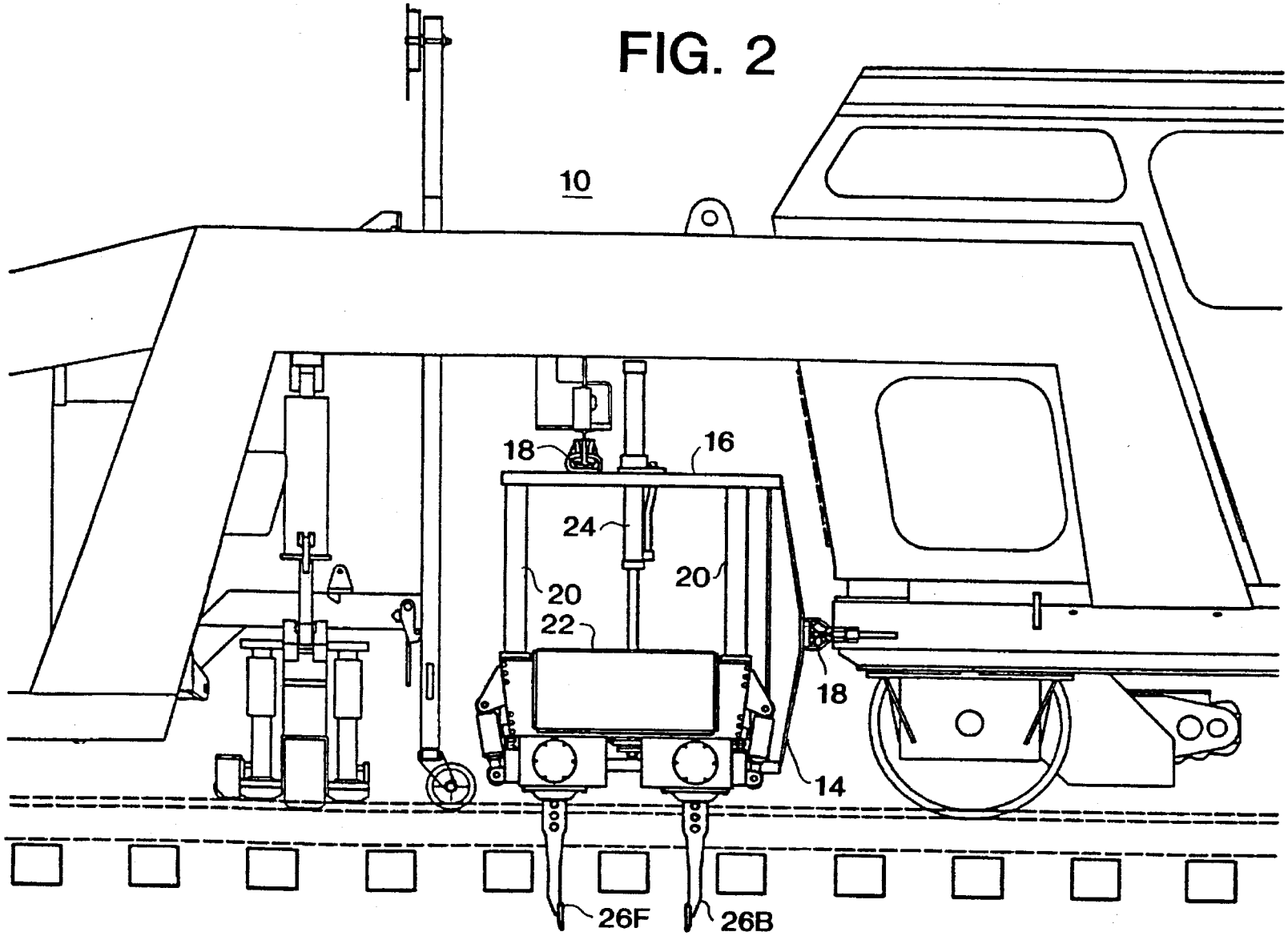
FIG. 2 is a larger side view of parts of the vehicle of FIG. 1.
Figure 3:
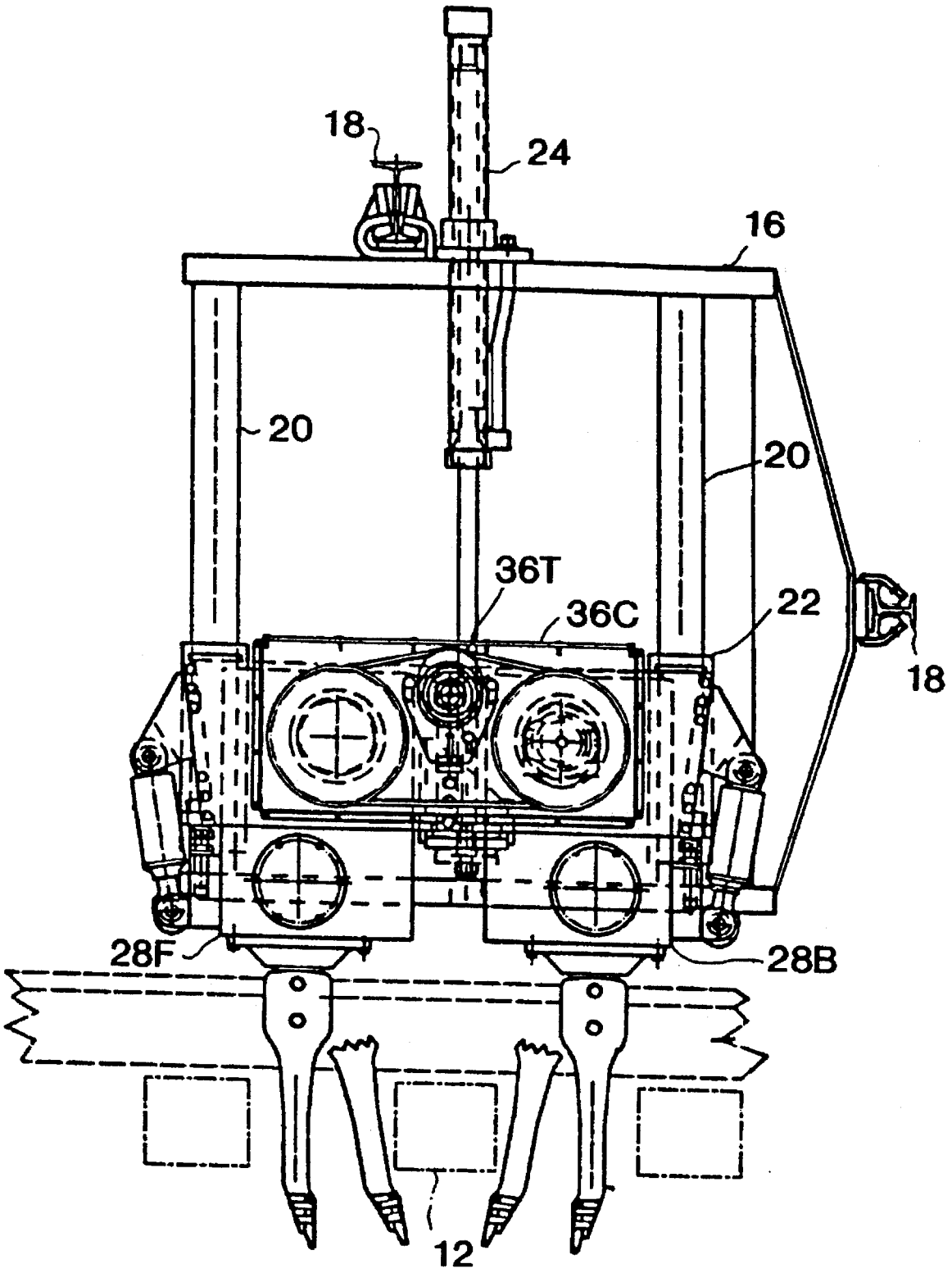
FIG. 3 is a side view of a split tool mechanical vibrator of the present invention with parts of a belt cover broken away.

The tamping assembly 14 is shown in more detail in FIGS. 2 and 3. A support frame 16 is slidably mounted to transverse beams 18, which are part of the vehicle main frame. The support frame may slide left and right (normal to the plane of view of FIGS. 2 and 3) relative to the vehicle 10 by using known techniques which need not be described herein. Support frame 16 has guide rods 20 on which a carrier frame 22 is movable up and down under control of lift hydraulic cylinder or actuator 24. The tamping assembly has front and back tamping tools 26F and 26B respectively, which may be inserted and removed from ballast (not shown) by operation of cylinder 24 moving carrier frame 22 relative to the support frame 16.

Figure 5A:
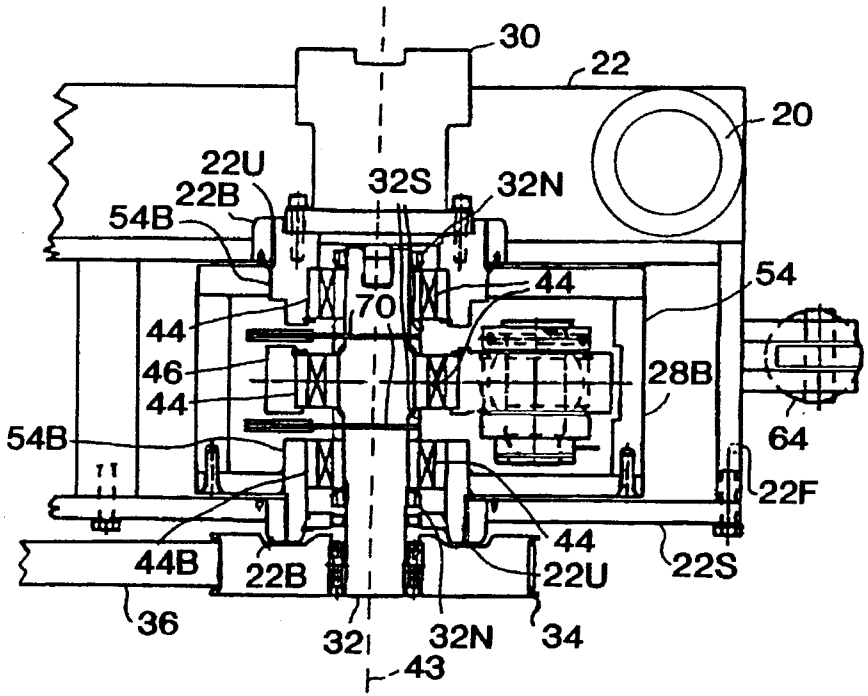
FIG. 5A is an enlarged cross section top view of a portion of the FIG. 5 structure.
Figure 4:
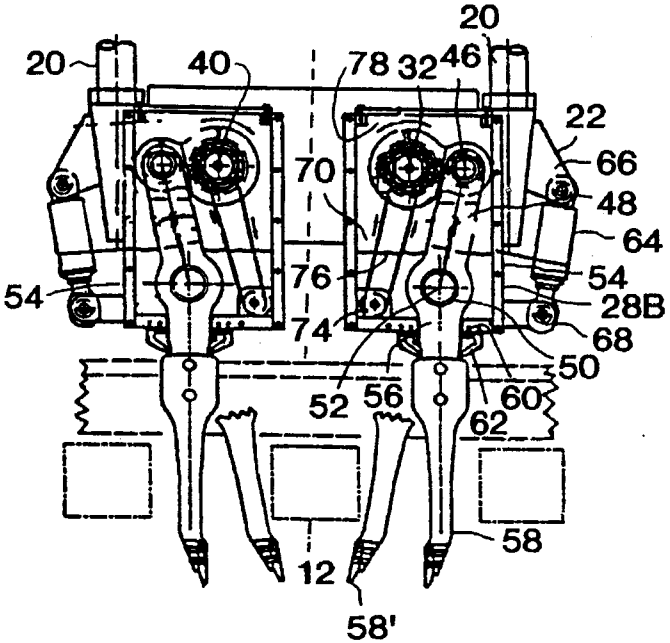
FIG. 4 is a cross section side view of the vibrator with various parts including a housing side removed for ease of illustration.
Figure 5:
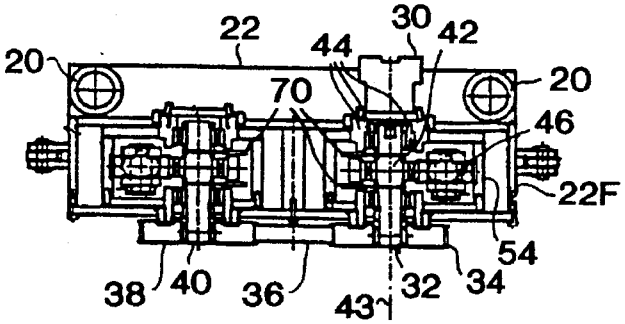
FIG. 5 is a cross section top view of the vibrator.

Referring now to FIGS. 3–5, a forward vibrator 28F and back vibrator 28B which are constructed identical in a symmetric fashion as mirror images except as will be specifically noted below. Basically, the back vibrator 28B serves as a driver for the front vibrator 28F. Specifically, hydraulic motor 30 disposed within a hole (not separately shown) in the frame 22 is mounted to vibrator 28B and rotates a back vibration inducing shaft 32 (pivotably mounted to the carrier frame 22) having synchronous sprocket 34 mounted on an end therein. Sprocket 34 is connected by synchronous belt 36 within belt cover 36C to a front sprocket 38, which in turn rotates a front vibration inducing shaft 40. The belt 36 is kept tight by tensioner 36T. The front vibration inducing shaft 40 is pivotably mounted to the vibrator 28F. Since the various components moved by rotation of the front and back shafts 40 and 32 are identical in construction and operation for the front vibrator 28F and back vibrator 28B, an explanation of the construction and operation of components of back vibrator 28B will be sufficient.

Referring to FIGS. 4, 5, and 5A, shaft 32 has an eccentric portion 42 which rotates with shaft 32 about its central axis 43. The eccentric portion 42 may be integral with shaft 32 or be a separate eccentric member rotatable therewith. Ball bearings 44 are around eccentric 42 and the left side (FIG. 4) of a connector member 46, which is shaped like a sideways FIG. 8 with a smaller right side. Rotation of the eccentric 42 moves the connector 46 right and left in FIG. 4. The right side of connector 46 is pivotably connected to the upper end of a tamping tool holder 48 such that the upper end is moved right and left in FIG. 4. The tool holder 48 has a middle portion with hole 50 therein and a tool holder mounting shaft 52 extends through the hole 50 to pivotably mount tool holder 48 to a back vibrator housing 54. (The side of the box-like housing 54 is removed from FIG. 4 and the top of housing 54 is removed from FIGS. 5 and 5A, all to more readily show the parts inside the housing 54.) Accordingly, the right and left movement of the upper end of tool holder 48 will cause the holder 48 to pivot back and forth about a central axis of the mounting shaft 52. This in turn causes a tamping tool accommodating lower end 56 to vibrate a tamping tool 58 mounted thereon left and right in FIG. 4 (forward and backward relative to the vehicle and the rails). The lower tip of tamping tool 58 will vibrate with about a ⅜ inch amplitude relative to the central axis of shaft 52. Thus, the central axis of shaft 52 may be considered as a vibration axis about which tamping tool 58 vibrates. This is, as shown, separate and offset from the center axis 43 (FIG. 5A) which serves as an axis for the squeeze in pivoting as discussed below. Slight front and back movements (left and right in FIG. 4) of lower end 56 of tool holder 48 are accommodated by a rubber seal 60 which is clamped to an opening in the floor of housing 54 and clamped to a portion of the lower end 56. The rubber seal 60 is protected from flying debris by a steel boot 62 having sufficient clearance to avoid interfering with vibration of the holder 48. The vibration of the tamping tool 58 eases its insertion into the ballast when lowered by cylinder 24 (refer back momentarily to FIG. 3).

After insertion into the ballast, tamping tool 58 is moved from its normal position (58 in right of FIG. 4) to its squeeze in position at 58' (forward of 58, left relative to FIG. 4). This movement is accomplished by extending a squeeze actuator 64 (specifically a hydraulic cylinder) having its upper end pivotably secured to a flange 66 fixed to carrier 22 and its lower end pivotably secured to a flange 68 fixed to rear vibrator housing 54. The extension causes the housing 54 and associated parts supported thereby including holder mount shaft 52 to pivot clockwise relative to carrier 22 in FIG. 4 about central axis 43 (FIG. 5) of vibration shaft 32. The advantageous feature of squeeze in pivoting about the same axis as used for the vibration inducing shaft helps keep the design relatively simple and compact. The movement of housing 54 and mount shaft 52 moves tamping tool 58 to its squeeze in position corresponding to 58'.

The details of parts within housing 54 and details of the squeeze in operation will be explained with reference to FIG. 5A. Mounted as part of frame 22 are first and second plates 22F and 22S respectively. Carrier bosses 22B are fixed to carrier frame 22 and have carrier bushings 22U therein. The bearings 44 (except bearing 44 associated with connector 46) are within vibrator housing bosses 54B which may rotate with housing 54 and associated components about axis 43 upon squeeze in operation. Bosses 54B are in turn within the carrier or frame bushings 22U, thus allowing the vibrator assembly 28B including motor 30, housing 54 and components therein and supported thereto to rotate relative to frame 22 about axis 43 upon extension or retraction of cylinder 64.

FIGS. 4, 5 and 5A will be used to explain a lubrication feature of the present invention. Specifically, the vibration inducing shaft 32 has two bearing spacers 32S fixed to shaft 32 and having circumferential grooves therein about which two corresponding lubricant carrying belts 70 (FIGS. 5 and 5A show both, only one visible in FIG. 4) extend. Although two such belts are shown, an alternative would simply use a single belt. The belts 70 extend down into a lower lubricant sump portion 72 of oil or other lubricant where each extends around a corresponding idler wheel 74 (one visible in FIG. 4 only). The lubricant belts are driven by the clockwise rotation of the shaft 32 to carry oil or other lubricant from below the lubricant level 76 and throw the oil on ceiling 78 such that it may drip onto and lubricate appropriate parts of connector 46, shaft 32, and related parts, thereby providing lubrication and cooling.

The belts 70 may have a round cross section or may have a twisted arrangement with a quick connect link, belts of both types being made by a company named Dura-Belt and sold under the DURA-BELT trademark.

It should again be noted that the front vibrator 28F is constructed such that it may vibrate and squeeze as discussed for back vibrator 28B, there being duplicate front components corresponding to all of the back components discussed except that the single hydraulic motor 30 vibrates the front by way of belt 36 and vibrates the back more directly. Advantageously, the vibrating sequence of the front vibrator 28F is 180 degrees out of phase with the back vibrator 28B to effectively cancel out any vibration force that would otherwise be transmitted to the main frame of the vehicle. The 180 degree phase difference is maintained by timing the front vibrator relative to the back vibrator by using the synchronous cog type belt 36. When the front vibrator is moving its tamping tool forward, the back vibrator will be moving its tamping tool backward. When the back vibrator is moving its tamping tool forward, the front vibrator will be moving its tamping tool backward. The front and back squeeze cylinders (only back 64 is numbered) would usually be operated at the same time so that both tamping tools push in opposite directions on ballast under a particular cross tie. The phase difference would preferably be 180 degrees, but more generally might be 170 to 190 degrees out of phase and even more generally might be 160 to 200 degrees out of phase.

Figure 6:
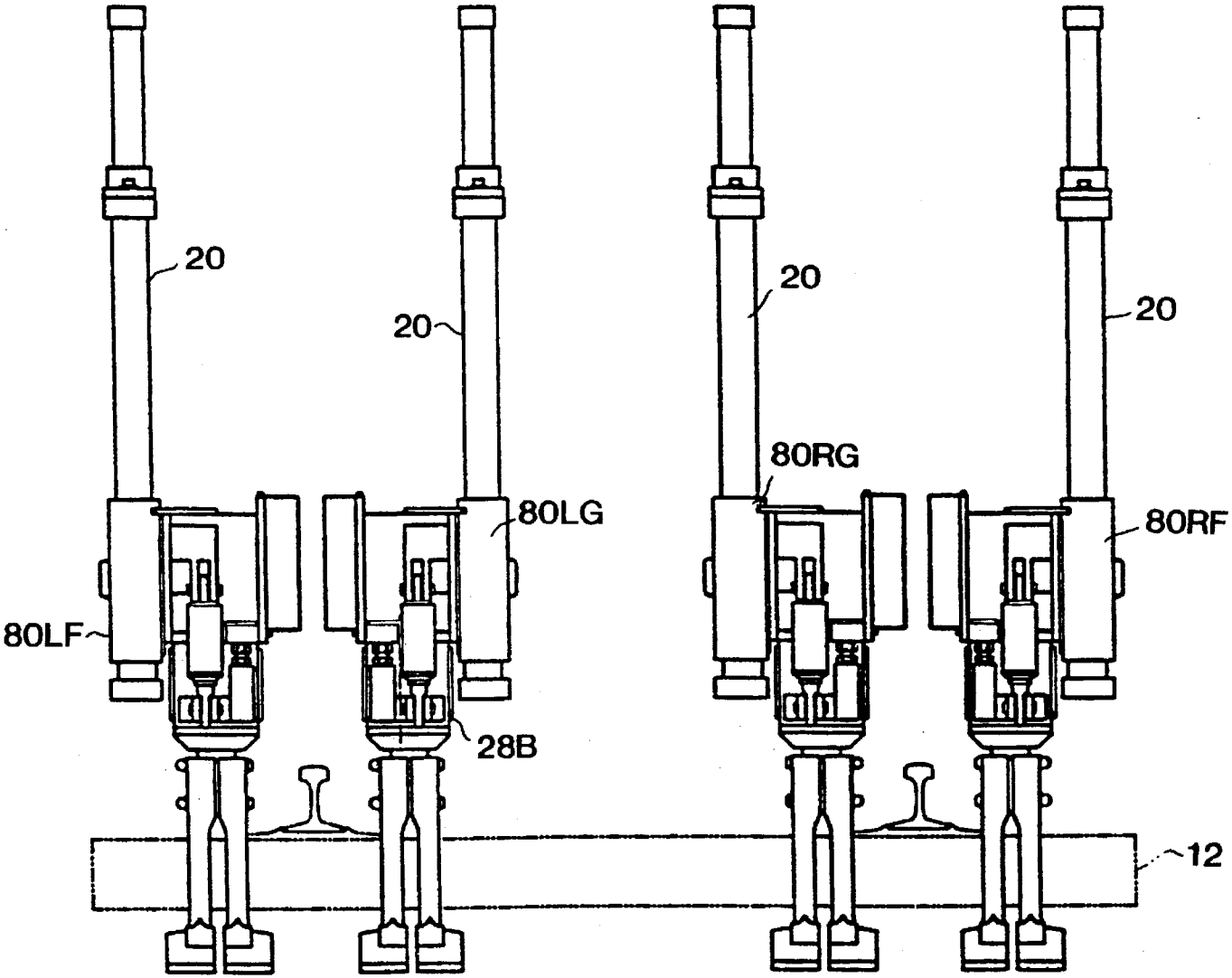
FIG. 6 is an end view showing four complete vibrator assemblies, each being one of the split tool mechanical vibrators.

With reference now to the back view of FIG. 6, there are four complete tamping assemblies 80LF, 80LG, 80RG, and 80RF corresponding to left field side, left gauge side, right gauge side, and right field side, each of them having a front and back vibrator such as 28F and 28B discussed below. They may have minor variations between them (not shown) such that the back vibrator of one may have a motor as discussed in connection with FIGS. 4, 5, and 5A, whereas the immediately adjacent assembly would have a motor on its front vibrator, thus facilitating the nesting of the structures. Each of the tamping assemblies is independently movable up and down on its own pair of guide rods 20 (only one for each assembly is visible in FIG. 6) using a corresponding support frame and cylinder 24. Each of the support frames would be movable transversely (left and right in FIG. 6) relative to the vehicle using known techniques not illustrated. Therefore, the field side assemblies may be movable to with the rails and/or the gauge side assemblies are movable out from between the rails. The terms gauge and field are used simply to indicate which side (gauge or field) the assembly is closest to. By having assembly 80LF movable up and down independently of the assembly 80LG, one can do tamping operations around railroad switches or in other difficult to access locations. In contrast, usual prior designs have gauge and field side assemblies united such that lifting of the left gauge side assembly for example requires lifting of the left field side assembly as well. Of course, such prior assemblies were constructed with numerous other differences relative to the present invention.

Figure 9:
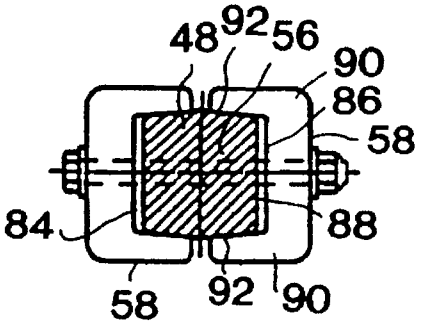
FIG. 9 is a cross section view taken along lines 9—9 of FIG. 8.
Figure 8:
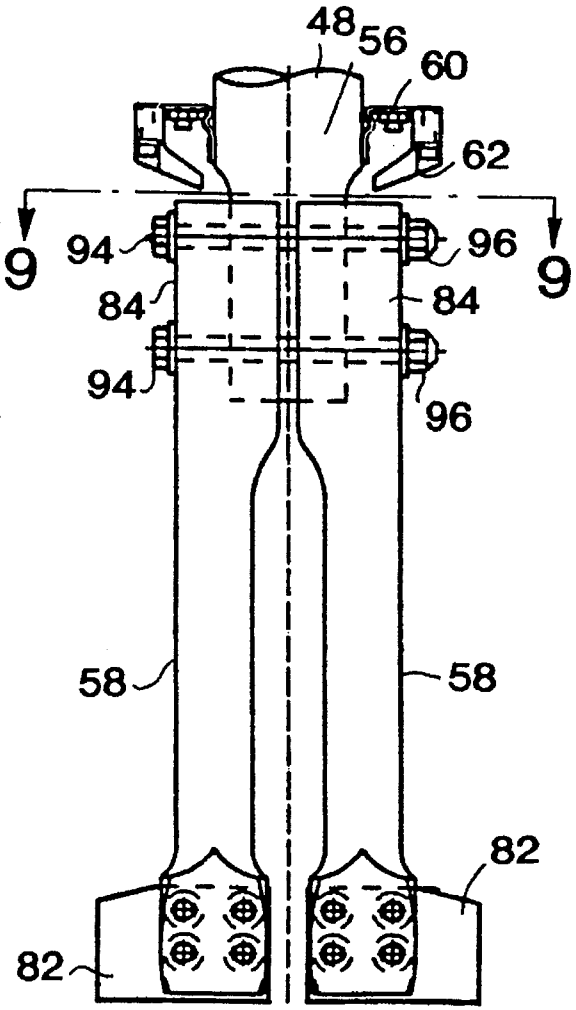
FIG. 8 is a front view of a tool holder portion and associated tamping tools.
Figure 7:
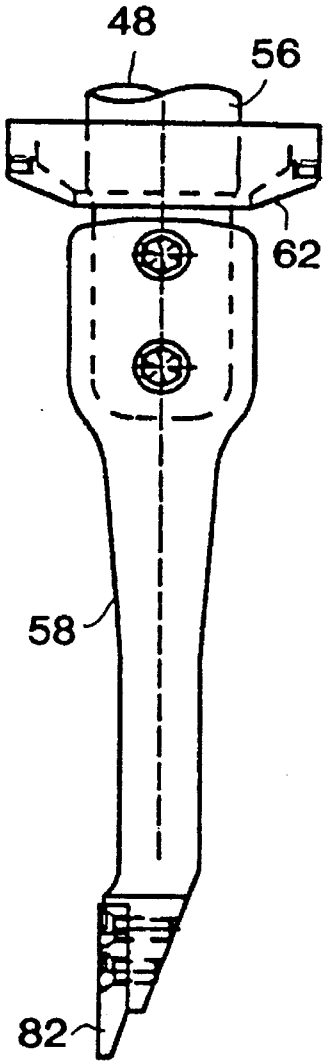
FIG. 7 is a side view of a tool holder portion and associated tamping tool.

With reference now to FIGS. 7–9, the attachment of tamping tools 58 to the lower end 56 of tamping tool holder 48 will be described. As shown in FIG. 8, two tamping tools 58 are attached to the lower end 56 of a tool holder 48. The tamping tools 58 are identical, one being the mirror image of the other. Each tamping tool has a paddle 82 bolted, welded, molded integrally therewith, or otherwise attached to a lower end thereof and a tool holder interface 84 at a top end thereof.

The tool holder interface 84 has a generally vertical surface 86 (i.e., it is within 20 degrees of vertical when fixed to a tool holder 48 in normal, not squeeze in position) which faces the opposing outer surface 88 of the tamping tool holder 48. The interface 84 is a channel having its generally vertical surface 86 as the floor of the channel and having two opposite channel sidewalls 90. The channel sidewalls 90 taper out and away from the floor 88 for partially wrapping about the tamping tool holder 48. Lower end 56 of holder 48 has sides 92 which taper together towards surface 88. The right and left halves of lower end 56 are mirror images of each other. More preferably, the generally vertically surface is within 10 degrees of vertical when fixed to a tool holder 48 in normal, not squeeze in position. Even more preferably, the generally vertically surface is within 5 degrees of vertical when fixed to a tool holder 48 in normal, not squeeze in position.

Bolts 94 extend through holes in the two tamping tools 58 and corresponding through holes in lower end 48 and are secured by self-locking nuts 96. The complementary tapering of sidewalls 90 and sides 92 creates a taper lock when the bolts are tightened in place. Bolts 94 and nuts 96 are readily accessible for attachment and removal purposes.

Although specific constructions have been presented herein, it is to be understood that these are for illustrative purposes only. Various modifications and adaptations will be apparent to those of skill in the art. In view of possible modifications, it will be appreciated that the scope of the present invention should be determined by reference to the claims appended hereto.

What is claimed is:

1. A railroad ballast tamping apparatus comprising a first tamping assembly having:

a first front vibration inducing shaft rotatable about a first front axis;

a first front tamping tool holder having a lower end accommodating a tamping tool thereon, the first front tamping tool holder being operably connected to the first front vibration inducing shaft such that rotation of the first front vibration inducing shaft about the first front axis causes vibration of any tamping tool connected to the first front tamping tool holder;

a first front belt wheel portion which is connected to rotate with the first front vibration inducing shaft;

a first back vibration inducing shaft rotatable about a first back axis;

a first back tamping tool holder having a lower end accommodating a tamping tool thereon, the first back tamping tool holder being operably connected to the first back vibration inducing shaft such that rotation of the first back vibration inducing shaft about the first back axis causes vibration of any tamping tool connected to the first back tamping tool holder;

a first back belt wheel portion which is connected to rotate with the first back vibration inducing shaft;

a first drive motor operably connected to a driving one of the first front vibration inducing shaft and first back vibration inducing shaft; and a first belt connecting the first front belt wheel portion and the first back belt wheel portion such that rotation of the driving one of the first front vibration inducing shaft and first back vibration inducing shaft will in turn rotate the other one of the first front vibration inducing shaft and first back vibration inducing shaft; and wherein the first tamping assembly further comprises:

a housing about at least a portion of the first front vibration inducing shaft and about an upper portion of the first front tamping tool holder, the housing having a lubricant sump at a lower portion thereof; and a first front eccentric portion on the first front vibration inducing shaft within the housing.

2. The railroad ballast tamping apparatus of claim 1 wherein the first tamping assembly further comprises two tamping tools mounted externally to one of the first front tamping tool holder and the first back tamping tool holder, each tamping tool having a tamping paddle at a bottom thereof and having a tool holder interface at a top thereof.

3. The railroad ballast tamping apparatus of claim 2 wherein the first tamping assembly further comprises:

a first carrier supporting the first front vibration inducing shaft and the first front tamping tool holder; and a first front squeeze actuator connected to the first carrier and operably connected to the first front tamping tool holder to move any tamping tool mounted to the first front tamping tool holder between a normal position and a squeeze in position by rotating the first front tamping tool holder about the first front axis.

4. The railroad ballast tamping apparatus of claim 3 wherein the first carrier supports the first back vibration inducing shaft and the first back tamping tool holder; and further comprising a first back squeeze actuator connected to the first carrier and operably connected to the first back tamping tool holder to move any tamping tool mounted to the first back tamping tool holder between a normal position and a squeeze in position by rotating the first back tamping tool holder about the first back axis.

5. The railroad ballast tamping apparatus of claim 2 wherein each tool holder interface has a generally vertical surface which faces an opposing outer surface of a tamping tool holder with the tamping tool secured to a tamping tool holder, and wherein each tool holder interface is a channel having its generally vertical surface as the floor of the channel and having two opposite channel sidewalls, the channel sidewalls and floor partially wrapping about the tamping tool holder to which the two tamping tools are mounted.

6. The railroad ballast tamping apparatus of claim 1 wherein the first tamping assembly further comprises a first front connector pivotably connected to an upper end of the first front tamping tool holder and connected to the first front eccentric portion within the housing such that rotation of the first eccentric portion moves the first front connector back and forth which in turn vibrates the first front tamping tool holder and any tamping tool mounted thereto and further comprising a first back eccentric portion on the first back vibration inducing shaft and a first back connector pivotably connected to an upper end of the first back tamping tool holder and connected to the first back eccentric portion such that rotation of the first eccentric portion moves the first back connector back and forth which in turn vibrates the first back tamping tool holder and any tamping tool mounted thereto.

7. The railroad ballast tamping apparatus of claim 1 wherein the first tamping assembly further comprises at least one tamping tool mounted to the first front tamping tool holder and at least one tamping tool mounted to the first back tamping tool holder.

8. The railroad ballast tamping apparatus of claim 1 wherein the first tamping assembly further comprises two tamping tools mounted to one of the first front tamping tool holder and the first back tamping tool holder, each tamping tool having a tamping paddle at a bottom thereof and having a tool holder interface at a top thereof, the tool holder interface having a generally vertical surface which faces an opposing outer surface of the one of the first front tamping tool holder and the first back tamping tool holder with the two tamping tools secured to opposite sides thereof.

9. The railroad ballast tamping apparatus of claim 1 wherein the first tamping assembly further comprises at least one tamping tool mounted to one of the first front tamping tool holder and the first back tamping tool holder, the tamping tool having a tamping paddle at a bottom thereof and having a tool holder interface at a top thereof, the tool holder interface having a generally vertical surface which faces an opposing outer surface of a tamping tool holder with the tamping tool secured to a tamping tool holder.

10. The railroad ballast tamping apparatus of claim 1 wherein the first tamping assembly wherein the housing has a lubricant sump at a lower portion thereof; and further comprising:

a lubricant carrying belt within the housing and driven by the first vibration inducing shaft to carry lubricant from the lubricant sump up for lubrication above the lubricant sump.

11. The railroad ballast tamping apparatus of claim 1 wherein the first front belt wheel portion and the first back belt wheel portion are respectively first front and first back sprockets.

12. The railroad ballast tamping apparatus of claim 1 further comprising a second tamping assembly having:

a second front vibration inducing shaft rotatable about a second front axis;

a second front tamping tool holder having a lower end accommodating a tamping tool thereon, the second front tamping tool holder being operably connected to the second front vibration inducing shaft such that rotation of the second front vibration inducing shaft about the second front axis causes vibration of any tamping tool connected to the second front tamping tool holder;

a second front belt wheel portion which is connected to rotate with the second front vibration inducing shaft;

a second back vibration inducing shaft rotatable about a second back axis;

a second back tamping tool holder having a lower end accommodating a tamping tool thereon, the second back tamping tool holder being operably connected to the second back vibration inducing shaft such that rotation of the second back vibration inducing shaft about the second back axis causes vibration of any tamping tool connected to the second back tamping tool holder;

a second back belt wheel portion which is connected to rotate with the second back vibration inducing shaft;

a second drive motor operably connected to a driving one of the second front vibration inducing shaft and second back vibration inducing shaft; and a second belt connecting the second front belt wheel portion and the second back belt wheel portion such that rotation of the driving one of the second front vibration inducing shaft and second back vibration inducing shaft will in turn rotate the other one of the second front vibration inducing shaft and second back vibration inducing shaft; and wherein the first and second tamping assemblies are supported for independent vertical movement by a tamping vehicle, one of the first and second tamping assemblies being a field side assembly and the other of the first and second assemblies being a gauge side assembly.

13. A railroad ballast tamping apparatus comprising:

a first vibration inducing shaft rotatable about a first axis;

a first drive motor operably connected to the first vibration inducing shaft;

a first tamping tool holder having a lower end accommodating a tamping tool thereon, the first tamping tool holder being operably connected to the first vibration inducing shaft such that rotation of the first vibration inducing shaft about the first axis causes vibration of any tamping tool connected to the first tamping tool holder, the vibration of the tamping tool being about a first vibration axis separate and offset from the first axis;

a first carrier supporting the first vibration inducing shaft and the first tamping tool holder; and a first squeeze actuator connected to the first carrier and operably connected to the first tamping tool holder to move any tamping tool mounted to the first tamping tool holder between a normal position and a squeeze in position by rotating the first tamping tool holder about the first axis; and a housing about at least a portion of the first vibration inducing shaft and an upper portion of the first tamping tool holder, the housing having a lubricant sump at a lower portion thereof.

14. The railroad ballast tamping apparatus of claim 13 wherein the first tamping assembly further comprises:

a first belt wheel portion which is connected to rotate with the first vibration inducing shaft;

a second vibration inducing shaft rotatable about a second axis;

a second tamping tool holder having a lower end accommodating a tamping tool thereon, the second tamping tool holder being operably connected to the second vibration inducing shaft such that rotation of the second vibration inducing shaft about the second axis causes vibration of any tamping tool connected to the second tamping tool holder;

a second belt wheel portion which is connected to rotate with the second vibration inducing shaft; and a first belt connecting the first belt wheel portion and the second belt wheel portion such that rotation of a driving one of the first vibration inducing shaft and second vibration inducing shaft will in turn rotate the other one of the first vibration inducing shaft and second vibration inducing shaft; and wherein the first drive motor rotates the driving one of the first vibration inducing shaft and second vibration inducing shaft and the first belt will in turn rotate the other one of the first vibration inducing shaft and second vibration inducing shaft.

15. The railroad ballast tamping apparatus of claim 14 further comprising a second tamping assembly constructed in like fashion as recited for the first tamping assembly and wherein the first and second tamping assemblies supported for independent vertical movement by a tamping vehicle, one of the first and second tamping assemblies being a field side assembly and the other of the first and second assemblies being a gauge side assembly.

16. The railroad ballast tamping apparatus of claim 14 wherein the first tamping assembly further comprises a first eccentric portion on the first vibration inducing shaft and a first connector pivotably connected to an upper end of the first tamping tool holder and connected to the first eccentric portion such that rotation of the first eccentric portion moves the first connector back and forth which in turn vibrates the first tamping tool holder and any tamping tool mounted thereto, and a second eccentric portion on the second vibration inducing shaft and a second connector pivotably connected to an upper end of the second tamping tool holder and connected to the second eccentric portion such that rotation of the first eccentric portion moves the second connector back and forth which in turn vibrates the second tamping tool holder and any tamping tool mounted there; and wherein the first carrier supports the second vibration inducing shaft and the second tamping tool holder; and further comprising a second squeeze actuator connected to the first carrier and operably connected to the second tamping tool holder to move any tamping tool mounted to the second tamping tool holder between a normal position and a squeeze in position by rotating the second tamping tool holder about the second axis.

17. The railroad ballast tamping apparatus of claim 13 wherein the first tamping assembly further comprises a first eccentric portion on the first vibration inducing shaft and a first connector pivotably connected to an upper end of the first tamping tool holder and connected to the first eccentric portion such that rotation of the first eccentric portion moves the first connector back and forth which in turn vibrates the first tamping tool holder and any tamping tool mounted thereto.

18. The railroad ballast tamping apparatus of claim 13 wherein the first tamping assembly further comprises two tamping tools mounted to the first tamping tool holder, each tamping tool having a tamping paddle at a bottom thereof and having a tool holder interface at a top thereof, the tool holder interface having two generally vertical surfaces which face corresponding opposing outer surfaces of the two tamping tools with the two tamping tools secured to opposite sides of the first tamping tool holder.

19. The railroad ballast tamping apparatus of claim 13 wherein the first tamping assembly further comprises at least one tamping tool mounted to the first tamping tool holder, the tamping tool having a tamping paddle at a bottom thereof and having a tool holder interface at a top thereof, the tool holder interface having a generally vertical surface which faces an opposing outer surface of the first tamping tool holder with the tamping tool secured thereto.

20. The railroad ballast tamping apparatus of claim 13 wherein the first tamping assembly further comprises:

a lubricant carrying belt within the housing and driven by the first vibration inducing shaft to carry lubricant from the lubricant sump up for lubrication above the lubricant sump.

21. A railroad ballast tamping apparatus comprising a first tamping assembly:

a first vibration inducing shaft rotatable about a first axis;

a first tamping tool holder having a lower end accommodating a tamping tool thereon, the first tamping tool holder being operably connected to the first vibration inducing shaft such that rotation of the first vibration inducing shaft about the first axis causes vibration of any tamping tool connected to the first tamping tool holder;

a first housing about at least a portion of first vibration inducing shaft and an upper portion of the first tamping tool holder, the first housing having a first lubricant sump at a lower portion thereof; and a first lubricant carrying belt within the first housing and driven by the first vibration inducing shaft to carry lubricant from the first lubricant sump up for lubrication above the first lubricant sump; and wherein the first tamping assembly further includes a first idler wheel with the first lubricant carrying belt extending around the first idler wheel.

22. The railroad ballast tamping apparatus of claim 21 wherein the first tamping assembly further includes:

a second vibration inducing shaft rotatable about a second axis;

a second tamping tool holder having a lower end accommodating a tamping tool thereon, the second tamping tool holder being operably connected to the second vibration inducing shaft such that rotation of the second vibration inducing shaft about the second axis causes vibration of any tamping tool connected to the second tamping tool holder;

a second housing about at least a portion of second vibration inducing shaft and an upper portion of the second tamping tool holder, the second housing having a second lubricant sump at a lower portion thereof; and a second lubricant carrying belt within the second housing and driven by the second vibration inducing shaft to carry lubricant from the second lubricant sump up for lubrication above the second lubricant sump.

23. The railroad ballast tamping apparatus of claim 22 wherein the first tamping assembly further includes:

a first belt wheel portion which is connected to rotate with the first vibration inducing shaft;

a second vibration inducing shaft rotatable about a second axis;

a second tamping tool holder having a lower end accommodating a tamping tool thereon, the second tamping tool holder being operably connected to the second vibration inducing shaft such that rotation of the second vibration inducing shaft about the second axis causes vibration of any tamping tool connected to the second tamping tool holder;

a second belt wheel portion which is connected to rotate with the second vibration inducing shaft; and a first belt connecting the first belt wheel portion and the second belt wheel portion such that rotation of a driving one of the first vibration inducing shaft and second vibration inducing shaft will in turn rotate the other one of the first vibration inducing shaft and second vibration inducing shaft; and wherein the first drive motor rotates the driving one of the first vibration inducing shaft and second vibration inducing shaft and the first belt will in turn rotate the other one of the first vibration inducing shaft and second vibration inducing shaft.

24. The railroad ballast tamping apparatus of claim 21 wherein the first tamping assembly further includes a first eccentric portion on the first vibration inducing shaft and a first connector pivotably connected to an upper end of the first tamping tool holder and connected to the first eccentric portion such that rotation of the first eccentric portion moves the first connector back and forth which in turn vibrates the first tamping tool holder and any tamping tool mounted thereto.

25. The railroad ballast tamping apparatus of claim 24 wherein the first tamping assembly further includes at least one tamping tool mounted to the first tamping tool holder, the tamping tool having a tamping paddle at a bottom thereof and having a tool holder interface at a top thereof, the tool holder interface having a generally vertical surface which faces an opposing outer surface of the first tamping tool holder.

* * * * *